United States Patent [19]

Namiki

[11] 4,019,024

[45] Apr. 19, 1977

[54] ROLLER FOR FIXING ELECTROPHOTOGRAPHIC TONER IMAGES AND METHOD OF PRODUCING THE SAME

[75] Inventor: Ryoichi Namiki, Hino, Japan

[73] Assignee: Ricoh Co., Ltd., Tokyo, Japan

[22] Filed: Mar. 7, 1975

[21] Appl. No.: 556,289

Related U.S. Application Data

[63] Continuation-in-part of Ser. No. 440,341, Feb. 7, 1974, abandoned, which is a continuation-in-part of Ser. No. 339,979, March 12, 1973, abandoned.

[30] Foreign Application Priority Data

Mar. 29, 1972 Japan ..... 47-31411

[52] U.S. Cl. ..... 219/469; 219/216; 219/470; 432/60; 432/228

[51] Int. Cl.² ..... B21B 27/06; H05B 3/02

[58] Field of Search ..... 219/216, 469–471; 432/60, 228; 29/132; 100/93 RP

[56] References Cited

UNITED STATES PATENTS

| | | | |
|---|---|---|---|
| 3,452,181 | 6/1969 | Stryjewski | 219/469 X |
| 3,669,706 | 6/1972 | Sanders et al. | 219/216 X |
| 3,921,573 | 11/1975 | Thettu | 432/60 |

*Primary Examiner*—C. L. Albritton
*Attorney, Agent, or Firm*—Cooper, Dunham, Clark, Griffin & Moran

[57] ABSTRACT

An image fixing roller having a comparatively long service life and tending to resist the so-called "offset phenomenon" in which portions of the toner image on one sheet adhere to the roller and are transferred onto the next sheet bearing a toner image. The roller has a radially outer layer made of silicon rubber impregnated with silicon oil which is non-tacky, heat resistant and resilient and has hardness of 20 to 70, tear strength of 10 to 15 kg/cm and tensile strength of below 70 kg/cm².

7 Claims, 4 Drawing Figures

ROLLER FOR FIXING ELECTROPHOTOGRAPHIC TONER IMAGES AND METHOD OF PRODUCING THE SAME

CROSS REFERENCE TO RELATED APPLICATION

This is continuation-in-part of applicant's copending application Ser. No. 440,341 executed Mar. 5, 1973 and filed on or about Feb. 7, 1974, now abandoned, for Device for Fixing Electrophotographic Toner Images, Attorney's Docket No. 9942-A. The copending application Ser. No. 440,341 is a streamlined continuation of the parent application Ser. No. 339,979 filed on or about Mar. 12, 1973 and now abandoned.

BACKGROUND OF THE INVENTION

The invention relates to image fixing in electrophotography, and is specifically concerned with a roller for heat-fixing a toner image on a support sheet and method of producing the same.

The most efficient way of fixing a toner image is to heat the image by pressing the support sheet against a heating roller to thereby fix the image by fusion or melt adhesion. One disadvantage of such fixing is the so-called "offset phenomenon". This phenomenon occurs when the toner particles forming the image are rendered tacky by heating, and portions of the toner image adhere to the periphery of the heating roller, and are thereby transferred onto the successive sheet or sheets which come in contact with the roller. The cycle is repeated, and results in copies of poor quality.

Several means have been devised to preclude or reduce the effects of this offset phenomenon. For example, the radially outward surface of the rollers used for heat fixing of toner images has been made of materials which are very hard. Silicon oil has been applied to the radially outward surface to provide a protective coating and to prolong the service life of the roller. However, when there is no silicon oil coating, or when there are discontinuities in the silicon oil coating, the radially outward surface of such rollers tends to deteriorate and their service life tends to be shortened because of the heat to which the rollers are exposed and because of the friction between the rollers and the toner image bearing sheets.

SUMMARY OF THE INVENTION

The object of the invention is to provide a device for fixing electrophotographic toner images by means of an image fixing roller having a comparatively long service life and tending to prevent the so-called offset phenomenon in which a portion of the toner image on one sheet adheres to the roller and is transferred onto a succeeding sheet.

An image fixing roller utilizing the invention comprises a radially outer layer made of a mterial, consisting of silicon rubber impregnated with silicon oil, which is non-tacky, heat resistant and resilient and is characterized by rubber hardness of 20 to 70, tear strength of 10 to 15 kg/cm and tensile strength of below 70 kg/cm². The invention thus ingeniously utilizes the fact that a roller having a layer of such material shows controlled surface deterioration when exposed to heat and friction, and wears away at the surface so as to renew its fixing surface as it is used for fixing toner images and to thus reduce the possibility of toner particles from a previous toner image transferred onto a successive sheet. The radially outer surface of a roller constructed according to the invention deteriorates when exposed to heat and to friction with the support sheets bearing toner images, and wears off readily so as to maintain a fresh fixing surface.

DETAILED DESCRIPTION

Figure 1:
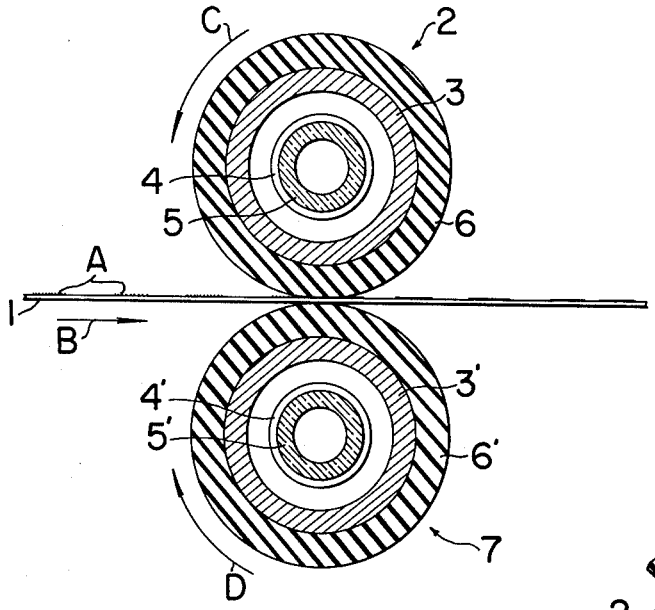
FIG. 1 is a sectional view of an image fixing device incorporating a roller constructed according to the invention.

Referring to FIG. 1, a support sheet 1 bearing a toner image A on its upper side is moved in the direction of the arrow B by suitable means (not shown). A fixing roller 2 is disposed above the path of travel of the support sheet 1, so that the radially outer peripheral surface of the roller 2 is in direct contact with the toner image A and with the support sheet 1. The fixing roller 2 is supported by a coaxial tubular shaft 3, which is made of a material such as a metal and form the core of the fixing roller 2. The tubular shaft 3 is suitably rotatably supported such that the roller 2 rotates in the direction of the arrow C. A heat source 4 is disposed within the tubular shaft 3 to heat the roller 2. The heat source 4 comprises a coil heater which is wound on a glass rod 5 disposed within the tubular shaft 3 and coaxial therewith. The tubular shaft 3 is surrounded by a roll layer 6 which is made of a material having a special system which is prepared in accordance with the invention. The material preferably is silicon rubber which comprises network polymer and is impregnted with silicon oil, the oil being in the form of so-called free oil. Such rubber is non-tacky, heat resistant and resilient, has rubber hardness of 20 to 70 (Japanese Industrial Standards), tear strength of 10 to 15 kg/cm and tensile strength of below 70 kg/cm².

A pressing roller 7 is disposed immediately below the fixing roller 2 and is constructed in an identical manner. The corresponding portion of the two rollers are identified by the same numerals, with the reference numerals of the pressing roller 7 being primed. The pressing roller 7 is suitably supported to rotate in the direction of the arrow D. The rollers 2 and 7 are in pressing engagement with each other, and the support sheet 1 bearing the toner image A moves between the two rollers in the direction of the arrow B.

In operation, when the support sheet 1 bearing the toner image A on its upper side moves between the image fixing roller 2 and the pressing roller 7, the toner image A is brought into direct contact with the radially outer peripheral surface of the roller 2, which is heated to a suitable temperature by means of the heat source 4. The toner particles forming the image A are fused, and the toner image A is fixed by melt adhesion to the support sheet 1. The rollers 2 and 7 press against each other with suitable force such that the pressure facilitates the fixing of the toner image A.

Figure 2:
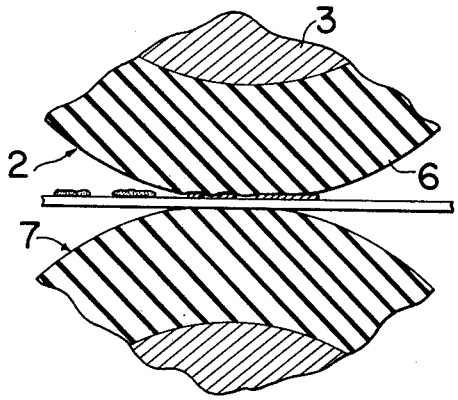
FIG. 2 is a magnification of a portion of FIG. 1.

As the roller 2 is heated by means of the heat source 4, and as it engages the support sheet 1 frictionally by virtue of the deformation of the surface portions of roll layer 6 as apparently shown in FIG. 2, the radially outer surface of the roll layer 6 tends to deteriorate and to wear away. This deterioration and wearing away is considered to be essentially effected by tearing of the network polymer forming the silicon rubber, and helps prevent or at least reduce the offset phenomenon, because toner particles which may adhere to the surface of the fixing roller 2 are worn away together with the surface to which they have adhered and thus a new surface on the fixing roller 2 together with silicon oil is presented for the next support sheet. It should be understood that deterioration and wearing away of the presented new surface cannot begin while the silicon oil thereon itself is effective to prevent the offset phenomenon. Thus, the surface of the fixing roller does not wear away in the course of fixing while silicon oil is present at the surface but starts wearing away only after the silicon oil that was present at the surface has been used up, and stops wearing away when a new surface having a sufficient concentration of silicon oil is presented to the copy sheet.

Experiments have been carried out by using a fixing roller constructed according to the invention and having a radially outer layer 6 made of silicon rubber having rubber hardness of 40. The results have shown that the radially outer surface of the roller keeps wearing away at the rate of 0.05 to 0.2 mm/10,000 sheets of B4 size (JIS) and the roller keeps contacting successive toner image bearing sheets with a new surface.

Figure 3:
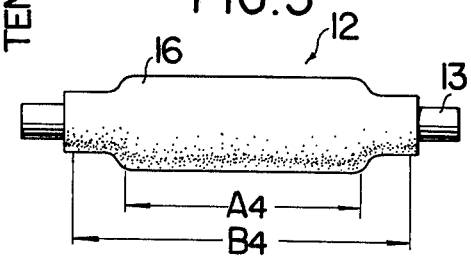
FIG. 3 is a plan view of a fixing roller constructed according to the invention.

FIG. 3 shows a fixing roller which is constructed taking into account of uneven consumption or tearing away of the layer surface thereof which would otherwise occur when two or more sizes of support sheets are used. The fixing roller 12 is adapted to use for support sheets of B4 and A4 sizes (JIS) and comprises core shaft 13 and silicon rubber layer 16 in similar manner to that of FIG. 1. The layer 16 has a slightly larger diameter portion, the axial length of which corresponds to the width of A4 size (JIS), than that of the remaining end portions by, to say, 1 mm. This construction helps prevent or at least reduce the uneven consumption of the layer surface by means of preliminarily compensating it.

In the embodiment shown and described above, the heat source 4 is built in the tubular shaft 3, but it is to be understood that it is not essential to provide a fixing roller with a built-in heater, and that the radially outer layer of the image fixing roller 2 may be heated by other means, such as from outside the fixing roller 2. It is also to be understood that the temperature of the roll layer 6, and particularly the temperature of its radially outer surface, may be increased to a temperature higher than that necessary for fixing, so that the radially outer surface of the layer 6 becomes even more fragile and wears away even more readily, and that it is possible in this manner to control the rate at which the radially outer surface of the layer 6 wears away.

Proceeding to show a method of making the image fixing roller described above, there is provided first a discussion of some problems in forming a silicon rubber layer on the surface of a backing (core) of metal or the like.

One of such problem arises when spraying the backing surface with a mixture of raw silicon rubber used as a base, vulcanizing agent, filler and solvent, such as toruene, and then heating the mixture on the backing surface at about 150° C in order to remove the solvent. The silicon rubber thus formed, however, is of no use for the present invention because of its undesirably high rubber hardness, tear strength and tensile strength (above 30°, above 15 kg/cm, and 50 to 70 kg/cm$^2$, respectively).

Another problem arises when a mixture similar to the above but without solvent is molded by injection molding and then maintained at room temperature for 3 to 24 hours. The resultant layer is also of no use its properties are similar to those of the silicon rubber discussed immediately above. In addition, it should be noted that case-hardening is found at the outer surface of the layer, resulting from a well-known interface reaction.

Figure 4:
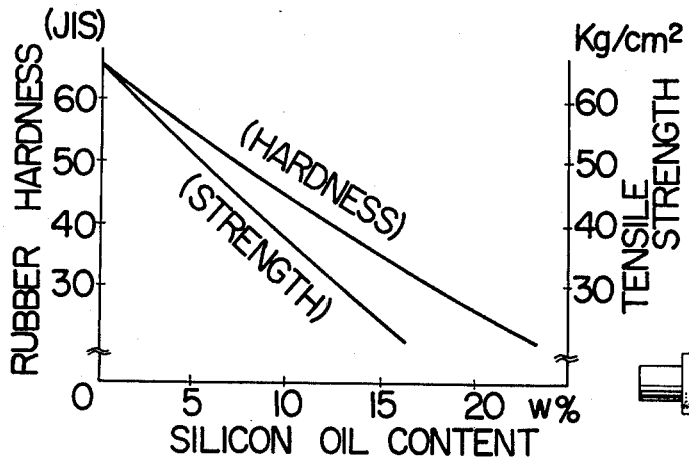
FIG. 4 is a graph showing variations of rubber hardness and tensile strength of silicon rubber against silicon oil contained therein.

The present invention provides the use of silicon oil having a low viscosity, e.g., below 1000 cs, preferably below 200 cs for mitigating crosslinking of raw silicon rubber or silicon oil of above 1000 cs, preferably above 2000 cs so that the resultant silicon rubber presents such properties as required. FIG. 4 shows variations of these properties against silicon oil content. The mixture thus containing the silicon oil of low viscosity may be molded by injection molding and then maintained at room temperature for several hours, the number of hours dependent on the amount of catalyst that is used. The shell formed on the periphery of the silicon rubber layer by the case-hardening discussed above may be removed by means of grinding. Proceeding to molding, the core surface is preferably coated with a primer, such as silicon varnish, silane coupling or silicon rubber in view of the poor adhesiveness between silicon rubber and the core material which may be metal or the like.

The following show usable materials for the base and catalyst, usable range of low viscosity silicon oil content and properties of silicon rubber thus obtained.

Materials:
Base:
dimethyl-polysiloxane,
methylvinyl-polysiloxane,
phenyl-polysiloxane, and
phloro-polysiloxane
Catalyst:
dibutyl-tin-dilaurate,
dibutyl-tin-diacetate,
tin octanate, and
lead octanate
Silicon oil content:
4 to 40 w%, preferably 20 to 30 w %
Properties: (preferred)
Rubber hardness: 15° to 50° (JIS) — 35° ± 5°
Tear strength: 10 to 15 kg/cm — below 15 kg/cm
Tensile strength: 20 to 50 kg/cm$^2$ — about 25 kg/cm$^2$

What is claimed is:

1. An image fixing roller for electrophotography comprising a core, a roll layer disposed around the core and made of silicon rubber whose outer surface is ground, said roll layer being impregnated with silicon oil and being adapted to be heated for melting toner particles forming toner images, and the outer peripheral surface of the roll layer tending to wear off when exposed to heat and friction.

2. An image fixing roller according to claim 1 wherein said roll layer has a rubber hardness of 20 to 70, a tear strength of 10 to 15 kg/cm and a tensile strength of below 70 kg/cm$^2$.

3. A device as in claim 2 wherein the silicon rubber comprises a silicon compound selected from the group consisting of dimethtyl-polysiloxane, methylvinyl-polysiloxane and phloropolysiloxane.

4. A device as in claim 2 wherein the silicon oil impregnated roll layer comprises 4 to 40% by weight silicon oil uniformly distributed in the silicon rubber of the roll layer.

5. A device for fixing electrophotographic toner images comprising a roller having a cylindrical circumferential surface made of surface-ground silicon rubber impregnated with silicon oil and having low tear and tensile strength and tending to wear off when exposed to heat and friction, and means for heating said surface.

6. A device as in claim 5 wherein said silicon rubber has rubber hardness in the range of 20 to 70, tear strength of 10 to 15 kg/cm and tensile strength below 70 kg/cm$^2$.

7. A device as in claim 5 wherein said heating means comprises a cylindrical heat source disposed within said roller coaxially therewith.

* * * * *